United States Patent [19]

Lisiecki

[11] Patent Number: 4,582,246

[45] Date of Patent: Apr. 15, 1986

[54] FLAT TOP END CLOSURE FOR LIQUID CONTAINERS

[75] Inventor: Robert E. Lisiecki, Orchard Lake, Mich.

[73] Assignee: Ex-Cell-O Corporation, Troy, Mich.

[21] Appl. No.: 665,880

[22] Filed: Oct. 29, 1984

[51] Int. Cl.[4] ..... B65D 5/74

[52] U.S. Cl. ..... 229/17 R; 206/631; 229/7 R; 229/37 R

[58] Field of Search ..... 229/7 R, 17 R, 37 R, 229/17 G; 206/604, 626, 631

[56] References Cited

U.S. PATENT DOCUMENTS

| | | | |
|---|---|---|---|
| 2,521,208 | 9/1950 | Eaton | 229/37 R |
| 3,003,673 | 10/1961 | Clark et al. | 229/17 R |
| 3,144,195 | 8/1964 | Hennessey | 229/37 R |
| 3,147,904 | 9/1964 | Larson | 229/17 R |
| 3,281,054 | 10/1966 | Buttery et al. | 229/37 R |
| 3,743,164 | 7/1973 | Clark | 229/17 R |
| 4,422,570 | 12/1983 | Lisiecki | 229/17 R |

FOREIGN PATENT DOCUMENTS

| | | | |
|---|---|---|---|
| 671135 | 9/1963 | Canada | 229/17 R |
| 7504483 | 5/1975 | Netherlands | 229/17 R |
| 562966 | 7/1944 | United Kingdom | 229/17 R |

*Primary Examiner*—Steven M. Pollard
*Assistant Examiner*—Gary E. Elkins
*Attorney, Agent, or Firm*—John P. Moran

[57] ABSTRACT

There is disclosed herein a flat top end closure for a liquid carrying container, which includes two oppositely disposed, overlapped outer closure panels, and two oppositely disposed, three-segment fold-in panels, one of which serves as the pour spout when opened. Each of the three-segment fold-in panels includes a substantially triangular panel portion defined by converging diagonal score lines extending from the upper edge of the tubular container body, and a pair of fold-back panels integrally connected to and folded between the substantially triangular panel portion and the respective adjacent outer closure panels. Diagonal opening-assist score lines are formed on the outer closure panels. Adhesive patterns to facilitate the opening process are formed on the outside surface of the three-segment pour spout and on the inside surfaces of the pour spout fold-back panels and the adjacent panel segments bounded by the diagonal opening-assist score lines.

6 Claims, 9 Drawing Figures

FLAT TOP END CLOSURE FOR LIQUID CONTAINERS

TECHNICAL FIELD

This invention relates generally to thermoplastic coated paperboard containers for carrying liquids and blanks for constructing same and, more particularly, to an improved, easy openable flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same is conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example, in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force against the outside panel to bend the sealed fin downwardly.

In U.S. Pat. No. 4,206,867, a wide scoreline is formed on one side of the gable panels, in lieu of the above mentioned double score lines, with a conventional score line of the opposite side providing unequal foldback panels.

In the above-mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

U.S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tab is integrally formed on one outer closure panel for initial lifing of a portion of the pitcher pour spout, and an underlying lift tab is formed on one fold-back closure panel of another portion of the pitcher pour spout, in order to facilitate the opening process.

In liquid carrying paperboard container constructions generally, for sensitive food products, such as milk or fruit juice, it is essential that the top closure be thoroughly sealable so as to be clean and sanitary and yet be functional from the standpoint of including means for readily opening the pouring spout thereof. As illustrated and described in the above-mentioned U.S. Pat. No. 3,270,940, anti-adhesive or "adhesive" patterns have been utilized, primarily on one or both sides of the rib panels located outward of the infolded triangular fold-back panels and inward of the outer edge sealing flaps. In the flat top structure disclosed in the above-mentioned U.S. Pat. No. 4,422,570, wherein there is no conventional sealing fin, such as the usual rib panels and sealing flaps, other arrangements for releasably sealing the top closure are required.

DISCLOSURE OF THE INVENTION

Accordingly, a general object of the invention is to provide an improved flat end closure for a liquid carrying, paperboard container, wherein various features are included for providing a controlled separation of the spout panels included in flat top closures of the non-sealing fin type disclosed in the above-mentioned U.S. Pat. No. 4,422,570, to facilitate and enhance the easy opening thereof after a leak-proof sealing operation.

Another object of the inventions to provide an improved flat top end closure, wherein particular abhesive patterns, and/or selected embossments filled with a supplementary sealant material, and/or partial cut lines serve to facilitate the container opening operation.

A further object of the invention to provide an overlapped flat top end closure which is not formed from a sealed fin arrangement, and having a predetermined inner and outer surface abhesive pattern and an optional embossment for defining a selected area for containing a supplemental sealant within the contours of the abhesive pattern.

These and other objects and advantages of the invention will be apparent when reference is made to the following description and accompanying drawings.

BRIEF MODE OF CARRYING OUT THE INVENTION

Figure 5:
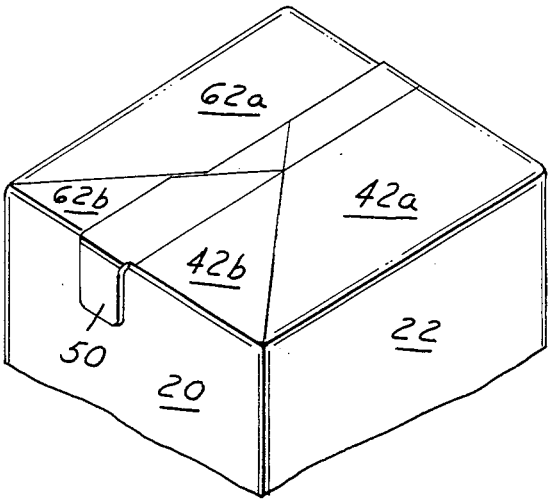
Figure 6:
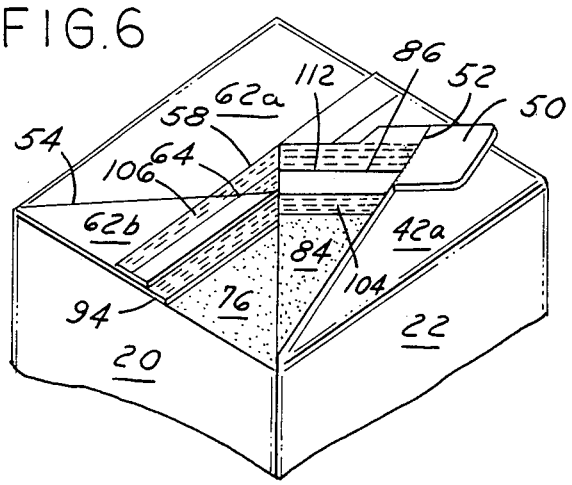
Figure 7:
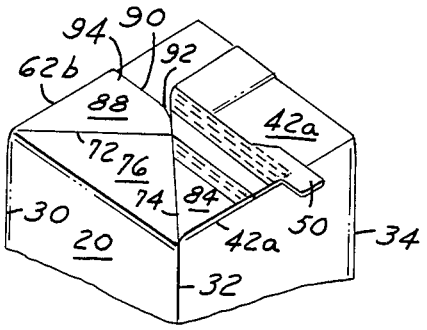
Figure 8:
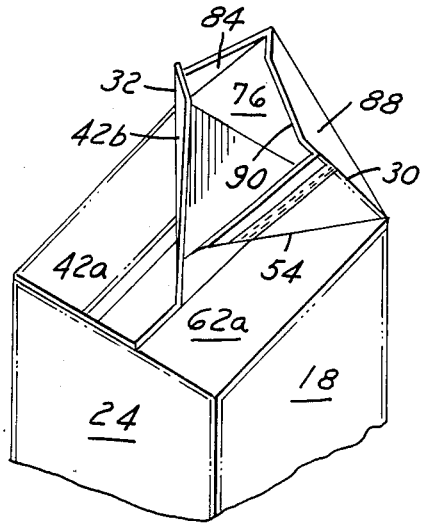
Figure 9:
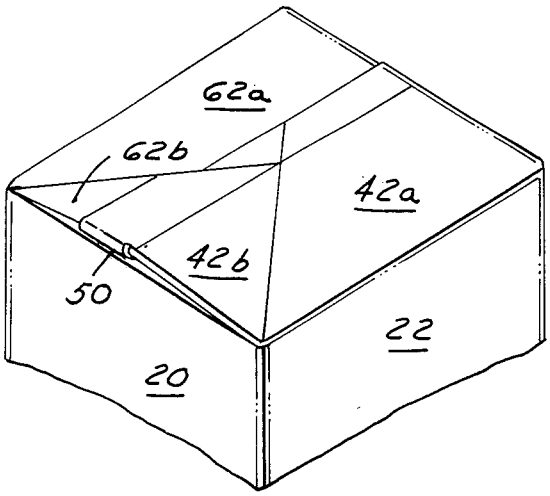

FIGS. 6, 7, and 8 are fragmentary perspective views illustrating sequentially various steps in opening the flat top end closure; and FIG. 9 is a fragmentary perspective view similar to FIG. 5, showing the top closure in a reclosed condition after having been opened.

BEST MODE OF CARRYING OUT THE INVENTION

Figure 1:
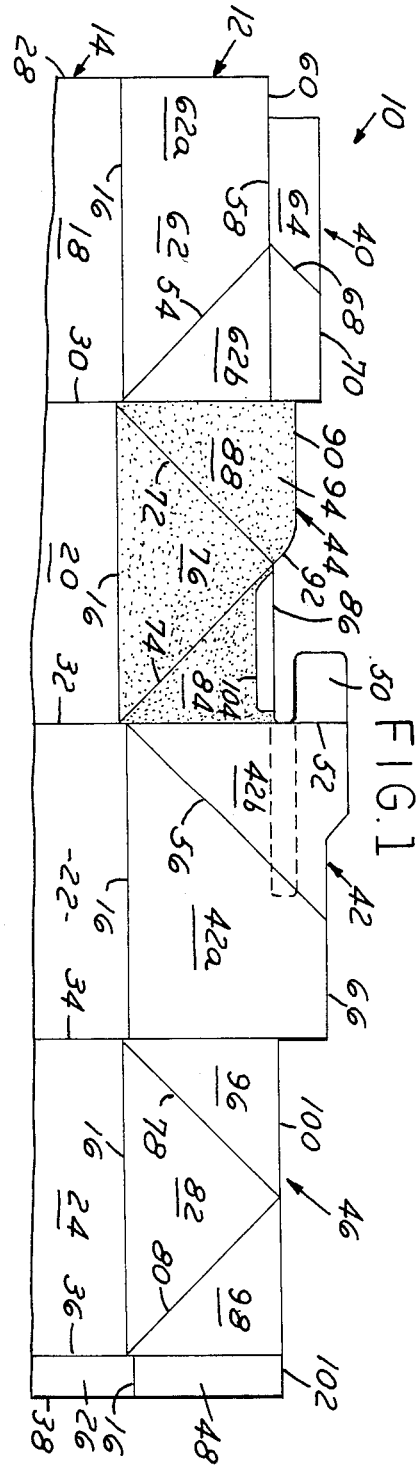
FIG. 1 is a fragmentary layout view of a blank from which the top end closure of the invention is formed, showing the outside surface thereof.
Figure 2:
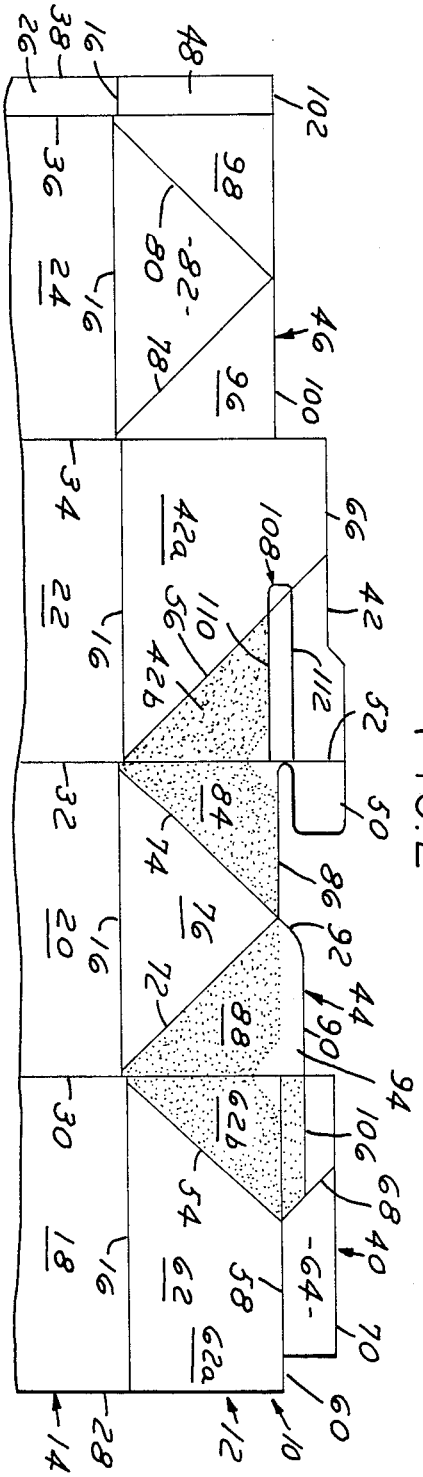
FIG. 2 is a fragmentary layout view of a blank from which the top end closure of the invention is formed, showing the inside surface thereon.

Referring now to the drawings in greater detail, FIGS. 1 and 2 illustrate the outside and inside surfaces of a blank 10 including a top closure portion 12 and a body portion 14, separated by a staggered horizontal score line 16. The latter includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 36, and a second free cut edge 38.

A pair of outer top closure panels 40 and 42 are integrally connected to the first and second side panels 18 and 22, respectively, at the score line 16. A pair of fold-in top panels 44 and 46 are integrally connected to the back and front panels 20 and 24, respectively, at the score line 16. The top panels are integrally connected to each other by the above-mentioned vertical score lines. An end closure extension 48 of the side seam 26 is integrally connected to the latter at the score line 16 and to the fold-in panel 46 at the score line 36. The panel 44 will serve as a pour spout, as will be explained.

A lift tab 50 is formed on the upper edge portion of the top panel 42 so as to be integrally connected thereto by a score line 52 extension of the vertical score line 32, extending laterally and substantially parallel to a portion of the free cut edge 86 of the panel 44.

Opening-assist diagonal score lines 54 and 56 are formed on the outer top panels 40 and 42, respectively. The line 54 extends substantially from the intersection of the vertical score line 30 and the horizontal score line 16 to a horizontal score line 58 formed across the panel 40. The score line 58 terminates in a free cut edge 60, and divides the panel 40 into panels 62 and 64, while the diagonal score line 54 divides the panel 62 into segments 62*a* and 62*b*, the latter serving as a fold-back panel. The score line 56 extends from the intersection of the score lines 32 and 16 to the free cut edge 66 of the panel 42, dividing the panel 42 into segments 42*a* and 42*b*, the lift tab 50 extending from the segment 42*b* and the latter serving as a fold-back panel. A diagonal score line 68 is formed across the panel 64 from the end of the diagonal score line 54 at the score line 58, to the free cut edge 70 of the panel 64.

A pair of converging diagonal score lines 72 and 74 are formed on the fold-in top panel 44, forming a triangular pouring panel 76 with the horizontal score line 16. Likewise, a pair of converging diagonal score lines 78 and 80 are formed on the fold-in top panel 46, forming a triangular panel 82 with the horizontal score line 16. The diagonal score lines 72, 74, 78 and 80 are preferably spaced at their lower ends slightly inward from the respective adjacent vertical score lines 30, 32, 34 and 36 along the horizontal score line 16, but may intersect the junctures of score lines 30 and 16, 34 and 16, 36 and 16, and 34 and 16, respectively, if desired.

There remains on the panel 44 a pair of fold-back panel portions consisting of a conventional panel portion 84 between the score lines 74 and 32 and a free cut edge portion 86 of the panel 44, and a longer panel portion 88 between the score lines 72 and 30 and a free cut edge portion 90 of the panel 44. An edge portion 92 extends at an angle between the adjacent ends of the cut edges 86 and 90, with one end substantially aligned with the diagonal score line 74 and the other end arcuately connected to the free cut edge 90.

It is the area of the longer panel portion 88 which extends past a continuation of the line formed by the free cut edge 86 which is adapted to serve as a lift tab 94, as will be explained.

The fold-in panel 46 includes fold-back panel portions 96 and 98, each comparable to the conventional panel portion 84. The panel portion 96 is defined by the score lines 78 and 34 and the free cut edge 100 of the panel 46. The panel portion 98 is defined by the score lines 80 and 36 and the free cut edge 100. A free cut edge 102 at the end of the side seam extension 48 aligns with the edge 100.

As shown in FIGS. 1 and 2, a first cut, represented by a line 104, may be formed parallel to the free cut edge 86, laterally across and partially through the thickness of the panel 84 from the outside thereof, and a second cut, represented by a line 106, may be formed intermediate the score line 58 and the free cut edge 70, partially through the thickness of the panel 64 from the inside thereof. Tests indicate that such partial cuts serve to enhance the initial opening operation of the pouring spout.

As an alternate to, or an addition to, the partial cuts 104 and 106, in order to promote an "easy opening" characteristic, a suitable "abhesive" or anti-sealant solution is applied to the outside surfaces of the panel segments 88, 76 and 84, i.e., the entire outer surface of the fold-in panel 44 except for the area of the panel segment 84 which is defined by the line 104 and the free cut edge 86. The abhesive is also applied to the inside surfaces of the panel segments 84 and 88, except for the portion of the lift tab 94; to that portion of the inside surface of the panel segment 42*b* which is adjacent the segment 84; and to the inside surface of the segment 62*b*, as well as the portion of the panel 64 which lies within the score lines 58, 68 and 30 and the partial cut line 106.

An embossment 108 is formed on the inside surface of the outer closure panel 42, beginning at the vertical score line 32 and extending across the panel segment 42*b* to a point just past the diagonal score line 56. As such, the embossment 108 is bounded by spaced parallel lines 110 and 112 straddling an imaginary line continuation of the free cut edge 86 of the adjacent panel segment 84. The line 112 is substantially aligned with the free cut edge 90 of the panel segment 88. The embossment 108 is filled with a suitable supplemental sealing material for the purpose of sealing while the top is closed permitting opening thereof without causing tearing of the paper fibers. If desired, the supplemental sealing material may be added to the embossment area without the initial formation of an embossment which serves essentially as a retainer for the sealing material. In lieu of using a supplemental sealing material in the area of the embossment, it may be desirable to control the quality of the seal by varying sealing temperature and pressure. The abhesive on the inside surface of the panel segment 42*b* ends at the line 110 edge of the embossment 108.

Figure 3:
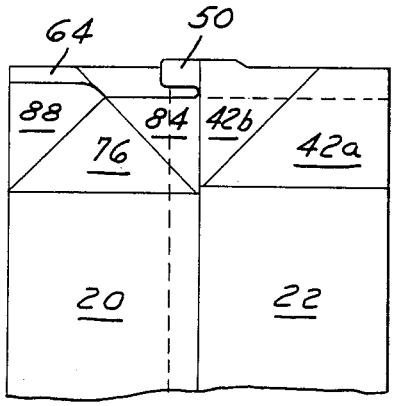
FIG. 3 is a fragmentary layout view of the outside surface of a blank after it is side seamed from the blank illustrated in FIG. 1.

The container blank 10 illustrated in FIGS. 1 and 2 is formed into a side seamed blank, as illustrated in FIG. 3, by rotating the body panel 24 and the side seam flap 26 as a unit about the vertical score line 34, and having the inside surfaces of the body panel 24 come into contact with the inside surface of the body panel 22, with the vertical score line 36 positioned next to the vertical score line 32, and with the inside surface of the side seam flap 26 in contact with the inside surface of the body panel 20 adjacent the vertical score line 32. The body panel 18 is then rotated about the vertical score line 30 to bring its inside surface into contact with the outside surface of the side seam flap 26, and the edge 28 is positioned parallel and substantially aligned with the vertical score line 36. The various members of the end closure 12 will make similar movements, and the container will appear as illustrated in FIG. 3. The container blank 10 is then sealed where the inside areas of the body panel 18 and the closure panel 40 come into contact with the outside surface of the side seam flap 26 and its extension 48.

Figure 4:
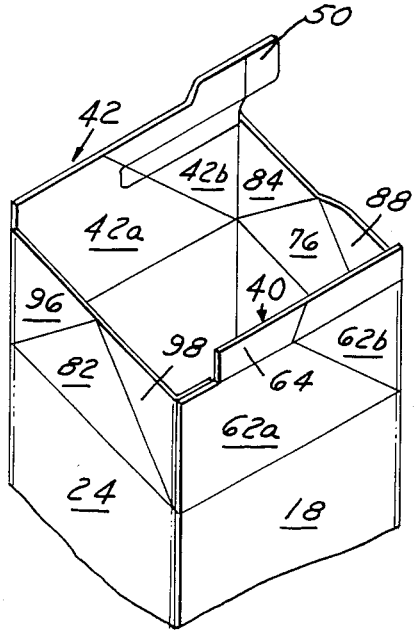
FIGS. 4 and 5 are fragmentary perspective views illustrating sequentially various steps in forming the flat top end closure.

The next step in forming the side seam blank into a container is illustrated in FIG. 4. The side seam blank is opened up into a squared or rectangular condition, after which the various parts of the end closure 12 are folded about the various score lines in the following manner. As may be noted from FIG. 5, the triangular closure panels 76 and 82 are moved around the horizontal score line 16 over the end of the container toward each other. At the same time, the outer panels 40 and 42 are also moved toward each other about the horizontal score line 16. This causes the fold-back panel portion 88 to bend around the vertical score line 30 such that the inside surfaces of the panel portion 88 and the outer panel 40 are approaching each other. Concurrently, the panel portion 84 is moved around the diagonal score line 74 such that the inside surfaces of the panel portion 84 and the panel 42 are approaching each other. The outside surfaces of the two fold-back panel portions 88 and 84 approach the outside of the triangular panel 76. The fold-back panel portions 96 and 98 make the same movements as described for the panel portions 84 and 88, with respect to their adjacent panels 42 and 82 and 40 and 82 respectively.

During the folding operation, the outer panel 42 contacts the panel portion 64 of the outer panel 40. The panel portion 64 is moved around the score line 58, approaching the panel portion 62. The result, as shown in FIGS. 6 and 7, is that an edge portion (FIG. 6) of the outer panel 42 overlaps and is sealed to the panel portion 64 (FIG. 6) of the outer panel 40, and the edge portion 94 of the panel 88 overlaps and is sealed to the edge portion 104 of the panel 84.

The lift tab 50 (FIG. 5) may be bent downwardly about the score line 52 and sealed against the front panel 20 to accommodate shipping and stacking.

Referring now to FIG. 6, it may be noted that opening of the flat top closure is effectuated by first releasing the lift tab 50 from the front body panel 20 and then using the released tab to lift the outer roof panel segment **42*b* and the underlying panel portion 84 about the respective diagonal score lines 56 and 74. This exposes the underlying portions of the panels 84, such that one may grasp the lift tab 94 portion of the panel 88, as defined by the free cut edges 90 and 92. Thus, by grasping and lifting the lift tab 94, the panel segments 88 and 62*b* are moved about the diagonal score lines 72 and 54, respectively. The pour spout shown in FIG. 8 is then opened as follows: the panel portions 76, 84 and 88 of the panel 44 are caused to assume a substantially planar attitude, as shown in FIG. 7, whereupon pressure against the vertical edge score lines 30 and 32 tends to cause the triangular panel portion 76 to extend outwardly. The lift tab 94 may be used to lift up the panel 88 and, hence, the triangular panel portion 76 and the panel 84 from their planar attitude and beyond, into the usual pitcher pour spout for dispensing the contents of the container. The pour spout may, of course, be generally reclosed after use. As shown in FIG. 9, the lift tab 50 may be tucked inwardly, between the fold-back panel 84 and the triangular pouring panel 76** to effectuate a "locking" condition for the reclosed flat top structure.

As indicated above, the opening process is enhanced by one or more of the partial cuts, the "abhesive" or anti-sealant patterns on the outside and inside surfaces of the opening panel, and the area of caulking material.

INDUSTRIAL APPLICABILITY

It is apparent that the resultant flat top container may be stacked more readily during shipping and display than is the case with the conventional gable top container.

It should also be apparent that the flat top closure of the invention may be easily opened by virtue of the two lift tabs and abhesive patterns formed at strategic locations on the inside and outside surfaces of the three-segment pouring spout and adjacent inside surfaces of the outer closure panels. The easy opening characteristic of the abhesive patterns may be enhanced by additional features, such as partial cuts parallel to free cut edges of the pouring end and/or an embossment filled with a suitable sealant.

While one general and two accompanying embodiments of the invention have been shown and described, other modifications thereof are possible within the scope of the following claims.

The embodiments of the invention in which an exclusive property or privilege is claimed are defined as follows:

1. In a flat top end closure for a liquid carrying, thermoplastic-coated paperboard container having a tubular body and including two oppositely disposed infolded panels and two oppositely disposed outer closure panels, one of said infolded panels adapted to serve as a pouring spout, said infolded panels each including a substantially triangular panel portion defined by converging diagonal score lines and being integrally connected to said tubular body, and a first pair of fold-back panels integrally connected to and folded between each of said substantially triangular panel portions and the respective adjacent outer closure panels, said two oppositely disposed outer closure panels including one shorter and one longer panel, with the edge portion of said longer panel overlapping the edge portion of said shorter panel and each having a diagonal opening-assist score line formed thereon and overlying said respective converging diagonal score lines to form a second pair of fold-back panels between said respective diagonal opening-assist score lines and said first pair of fold-back panels, a first lift tab formed on a side edge of said longer panel for lifting the portion of said overlying longer panel adjacent its diagonal opening-assist score line and the integrally connected underlying fold-back panel of said pouring spout, and a second lift tab formed on the other of said fold-back panels of said pouring spout for lifting said other fold-back panel and the portion of said overlying shorter closure panel adjacent its diagonal opening assist score line to enhance the opening of the infolded panel bearing said second lift tab into said pouring spout, the improvement comprising a first layer of a suitable abhesive material applied to the outer surfaces of said pouring spout and said second lift tab except for a portion immediately adjacent the outer edge of the integrally connected underlying fold-back panel which does not include said second lift tab, said portion being sealed to the adjacent inside surface of said second lift tab; a second layer of said suitable abhesive material applied to substantially the entire inner surfaces of one of said pairs of fold-back panels of said infolded panel bearing said second lift tab and of said outer closure panels intermediate said first pair of fold-back panels and said respective diagonal opening-assist score lines; and a sealant applied laterally across the inside surface of the portion of said longer outer closure panel between its diagonal opening-assist score line and said side edge on which said first lift tab is formed, substantially aligned with the free cut edge of the integrally connected underlying fold-back panel which does not include said second lift tab, in order to overlie and effectuate the sealing off of the crevice between the adjacent edges of the integrally connected underlying fold-back panel which does not include said second lift tab and the fold line formed between the fold-over panel and the shorter top closure panel, the second layer of said suitable abhesive material on said longer outer closure panel being terminated at the edge of said sealant.

2. The improvement described in claim 1, wherein said second layer of said suitable abhesive material is applied to substantially the entire inner surfaces of said set of fold-back panels of said infolded panel bearing said second lift tab.

3. The improvement described in claim 1, wherein said second layer of said suitable abhesive material is applied to substantially the entire inner surfaces of said set of said outer closure panels intermediate said pouring spout and said respective diagonal opening-assist score lines.

4. The improvement described in claim 1, and an embossment formed on said portion of said longer outer closure panel in the area of said sealant, said sealant filling said embossment.

5. The improvement described in claim 1, and a fold-over panel segment formed on the end of said shorter top closure panel; a reverse diagonal opening-assist score line formed on said fold-over panel segment so as to be aligned with the underlying opening-assist score line on said shorter top closure panel; and a third layer of said suitable abhesive material applied to a portion of the area of the inside surface of said fold-over panel adjacent the shorter top closure panel and bounded by said reverse diagonal opening-assist score line and the adjacent edge of said second lift tab, leaving an adjacent portion for sealing said fold-over panel to said shorter top closure panel.

6. The improvement described in claim 4, and a first straight line partial cut formed on the inside surface of said fold-over panel segment from a midpoint of said reverse diagonal opening-assist score line to the adjacent edge of said second lift tab, and a second straight line partial cut formed on the outside surface of said integrally connected underlying fold-back panel, defining said portion immediately adjacent the outer edge thereof.

* * * * *